US006645583B2

(12) United States Patent
Kaneshiro et al.

(10) Patent No.: US 6,645,583 B2
(45) Date of Patent: Nov. 11, 2003

(54) HEAT-SENSITIVE TRANSFER RECORDING MEDIUM

(75) Inventors: Yoshihide Kaneshiro, Osaka-fu (JP); Seigo Kato, Osaka-fu (JP); Yukihiro Uejima, Osaka-fu (JP)

(73) Assignee: Fujicopian Co., Ltd., Osaka-Fu (JP)

( * ) Notice: Subject to any disclaimer, the term of this patent is extended or adjusted under 35 U.S.C. 154(b) by 56 days.

(21) Appl. No.: 09/867,834

(22) Filed: May 30, 2001

(65) Prior Publication Data

US 2002/0012776 A1 Jan. 31, 2002

(30) Foreign Application Priority Data

May 31, 2000 (JP) ..... 2000-162420

(51) Int. Cl.[7] ..... B41M 5/40
(52) U.S. Cl. ..... 428/32.69; 428/32.8
(58) Field of Search ..... 428/195, 484, 428/488.1, 488.4, 32.69, 32.8

(56) References Cited

U.S. PATENT DOCUMENTS 5,219,638 A 6/1993 Imamura et al. ..... 428/195
5,362,549 A 11/1994 Imamura et al. ..... 428/195
5,620,508 A 4/1997 Yamano et al. ..... 106/23 A

FOREIGN PATENT DOCUMENTS

| | | | | |
|---|---|---|---|---|
| EP | 0 411 924 A2 | | 2/1991 | ..... B41M/5/38 |
| EP | 0 424 993 A1 | | 5/1991 | ..... B41M/5/38 |
| JP | 60212393 | | 10/1985 | ..... B41M/5/26 |
| JP | 61169283 | | 7/1986 | ..... B41M/5/26 |
| JP | 6166270 A | * | 6/1994 | |
| JP | 10067184 A | | 3/1998 | ..... B41M/5/40 |

* cited by examiner

*Primary Examiner*—Pamela R. Schwartz
(74) *Attorney, Agent, or Firm*—Fish & Neave

(57) ABSTRACT

A heat-sensitive transfer recording medium comprising a substrate and a heat-sensitive transfer ink layer provided on the substrate, the heat-sensitive transfer ink layer being a coating of a hot-melt ink containing no solvent therein, the heat-sensitive transfer ink layer containing carbon black having a DBP oil absorption of 100 to 200 ml/100 g and a BET specific surface area of 100 $m^2/g$ or less, and the heat-sensitive transfer ink layer having a surface resistivity of not more than $10^{13}$ Ω/□.

3 Claims, No Drawings

HEAT-SENSITIVE TRANSFER RECORDING MEDIUM

BACKGROUND OF THE INVENTION

The present invention relates to a heat-sensitive transfer recording medium.

In general, a heat-sensitive transfer recording medium is formed by applying an ink composed of a vehicle composed of a wax, a resin, etc. and a colorant onto a substrate. Depending on states at the time of application, the ink for use in the heat-sensitive transfer recording medium is mainly classified into a hot-melt ink containing no solvent and a solvent ink wherein a vehicle and a colorant are dissolved or dispersed into a solvent. The solvent ink has a greater degree of freedom in material selection, which makes it possible to provide inks having various characteristics. However, since a solvent is used, the material costs become higher correspondingly, and it also requires drying costs, resulting in higher costs, as compared with the hot melt ink.

In contrast, the hot-melt ink, which uses no solvent, is more advantageous as compared with the solvent ink. However, since the application of the hot-melt ink is conducted by a hot-melt coating method, the upper limit of the melt viscosity of the ink is restricted with the result that usable materials are limited, and it is difficult to obtain inks having various characteristics. For example, in the case of black ink, due to the restriction in the melt viscosity, it is necessary to use carbon black having a smaller DBP oil absorption as a colorant. However, the hot-melt ink without containing any solvent which uses carbon black having a small DBP oil absorption tends to cause poor conductivity in the ink layer after application, and troubles due to static electricity.

Moreover, even when an attempt is made to use conductive carbon black so as to solve the problem with the hot-melt ink containing no solvent, the conductive carbon black has a great DBP oil absorption and a great specific surface area, with the result that the melt viscosity of the hot-melt ink becomes greater, causing degradation in the coating property; thus, it has been considered that it is impossible to put this into practical use.

On the other hand, a method has been proposed in which, in a heat-sensitive recording medium using a hot-melt ink containing no solvent, a mat layer is placed between the substrate and the hot-melt ink layer so as to improve the readability of a printed image so that the gloss of the printed image is reduced and a conductive powder is used as a mat agent for the mat layer so as to prevent the troubles due to static electricity. However, it is necessary to add a considerable amount of the conductive powder to the mat layer in order to achieve sufficient conductivity in a thin film such as the mat layer. This causes a reduction in the strength of the mat layer, resulting in separation of the mat layer at the time of printing depending on printing conditions, and failure to obtain gloss-reducing effects in the printed image.

In view of the above-mentioned problems, an object of the present invention is to provide a heat-sensitive transfer recording medium which can prevent the occurrence of troubles due to static electricity without impairing the coating property of the hot-melt ink.

This and other objects of the present invention will become apparent from the description hereinafter.

SUMMARY OF THE INVENTION

The present invention provides a heat-sensitive transfer recording medium comprising a substrate and a heat-sensitive transfer ink layer provided on the substrate, the heat-sensitive transfer ink layer being a coating of a hot-melt ink containing no solvent therein, the heat-sensitive transfer ink layer containing carbon black having a DBP oil absorption of 100 to 200 ml/100 g and a BET specific surface area of 100 $m^2/g$ or less, and the heat-sensitive transfer ink layer having a surface resistivity of not more than $10^{13}$ Ω/□.

In an embodiment of the present invention, the DBP oil absorption of the carbon black is from 100 to 150 ml/100 g.

In another embodiment of the present invention, the hot-melt ink contains an oil-soluble dye.

In still another embodiment of the present invntion, the carbon black is contained in the hot-melt ink in a range of 5 to 50 parts by weight with respect to 100 parts by weight of the hot-melt ink, and the oil-soluble dye is contained in a range of 1 to 30 parts by weight with respect to 100 parts by weight of the carbon black.

In a further embodiment of the present invention, a mat layer is provided between the substrate and the heat-sensitive transfer ink layer.

DETAILED DESCRIPTION

The inventors of the present invention have studied intensively to solve the above-mentioned problems of troubles due to static electricity in the heat-sensitive transfer recording medium having a heat-sensitive transferring ink layer (hereinafter, referred to as "hot-melt ink layer") formed by coating a hot-melt ink containing no solvent, and have found that the use of carbon black having a DBP oil absorption of 100 to 200 ml/100 g and a BET specific surface area of 100 $m^2/g$ or less makes it possible to avoid an increase in the viscosity of the hot-melt ink because its specific surface area of the carbon black is small, and also to provide an hot-melt ink layer having a surface resistivity of not more than $10^{13}$ Ω/□ because its oil absorption is great, and consequently to prevent the occurrence of troubles due to static electricity, and have completed the present invention.

Moreover, the inventors also have found that the addition of an oil-soluble dye to the above-mentioned hot-melt ink containing no solvent makes it possible to further improve the fluidity at the time of the molten state of the hot-melt ink, and consequently to provide a superior coating property. In other words, it is considered that the oil-soluble dye is dissolved in a wax, a resin, etc. as a vehicle for the hot-melt ink, and adsorbed onto the surface of the carbon black particles so that it becomes possible to suppress aggregation of the dispersed carbon black particles, and consequently to prevent degradation in the ink fluidity due to aggregation of the carbon black particles. Since the carbon black used in the present invention has a small specific surface area, it is possible to reduce the amount of addition of the oil-soluble dye to be adsorbed on the carbon black particles; therefore, the amount of the dye that can be dissolved in the vehicle is sufficient to improve the ink fluidity.

The following description will discuss the present invention in detail.

The heat-sensitive transfer recording medium of the present invention has a basic structure which comprises a substrate and a hot-melt ink layer formed by applying a hot-melt ink containing no solvent onto the substrate, and another layer may be placed between the substrate and the hot-melt ink layer or on the hot-melt ink layer, if necessary.

The hot-melt ink containing no solvent, used in the present invention, is mainly composed of a colorant and a vehicle, and contains carbon black having a DBP oil absorption of 100 to 200 ml/100 g and a BET specific surface area of 100 $m^2/g$ or less as the colorant. Here, the DBP oil absorption is represented in terms of the number of ml of dibutyl phthalate that 100 g of the carbon black can absorb. A DBP oil absorption of less than 100 ml/100 g makes the surface resistivity of the hot-melt ink layer exceed $10^{13}$ Ω/□, resulting in a failure to prevent the occurrence of troubles due to static electricity. On the other hand, a DBP oil absorption exceeding 200 ml/100 g causes a reduction in the fluidity of the hot-melt ink in its molten state, resulting in degradation in the coating property. For this reason, it is preferable to use carbon black having a DBP oil absorption of not more than 150 ml/100 g. A BET specific surface area exceeding 100 $m^2/g$ tends to cause the melt viscosity of the hot-melt ink to become too high, resulting in degradation in the coating property. For this reason, the BET specific surface area is preferably less than 100 $m^2/g$, more preferably not more than 98 $m^2/g$. Although not particularly limited, the lower limit of the BET specific surface area is approximately 20 $m^2/g$ from the viewpoint of available market products. Examples of such specific carbon black commercially available include Toka Black #7350, Toka Black #7100F (made by Tokai Carbon Co., Ltd.), Raven 520, Raven 1040 (made by Columbia Carbon Japan Co., Ltd), and Printex 60, Printex 3 and Printex A (made by Degussa HÜFLS. LTD.), etc.

The proportion of the specific carbon black used in the hot-melt ink containing no solvent in the present invention is preferably in the range of 5 to 50 parts by weight, more preferably, 10 to 30 parts by weight, with respect to 100 parts by weight of the hot-melt ink containing no solvent. A proportion of the carbon black of less than the above-mentioned range tends to make the surface resistivity of the ink layer exceed $10^{13}$ Ω/□, resulting in insufficiency in the conductivity and possible troubles due to static electricity. On the other hand, a proportion exceeding the above-mentioned tends to cause a reduction in the fluidity of molten ink, resulting in degradation in the coating property.

In a preferred embodiment of the present invention in which an oil-soluble dye is used in combination with carbon black, the proportion of the oil-soluble dye used is preferably in the range of 1 to 30 parts by weight, more preferably, 5 to 25 parts by weight, with respect to 100 parts by weight of carbon black. A proportion of the oil-soluble dye of less than the above-mentioned range fails to sufficiently exert the effect of improving the ink fluidity. A proportion of the oil-soluble dye exceeding the above-mentioned range causes rather a reduction in the ink fluidity, and possible degradation in the coating property.

With respect to the oil-soluble dye, examples thereof include azine dyes, monoazo dyes, metal-complex type monoazo dyes, anthraxquinone dyes, phthalocyanine dyes, triaryl methane dyes, etc., and in particular, among these, black type and blue type oil-soluble dyes are preferably used. More specifically, Nigrosine Base, Oil Black, Valifast Black (made by Orient Kagaku Kogyo Kabushiki Kaisha), Aizen Spilon Black, Aizen Spilon Blue (made by Hodogaya Chemical Co., Ltd.), Sumiplast Black (made by Sumitomo Chemical Co., Ltd.), Diaresin (made by Mitsubishi Chemical Corporation), and the like are exemplified. These oil-soluble dyes may be used alone, or two or more kinds of these may be used in combination.

As the vehicle of the hot-melt ink containing no solvent in the present invention, waxes and thermoplastic resins conventionally used for heat-sensitive transfer recording materials may be used without any particular limitation. Usually, a vehicle which comprises a wax as a main component and uses a thermoplastic resin in combination, if necessary, is preferably used.

Examples of the above-mentioned waxes include natural waxes such as lanolin, carnauba wax, candelilla wax, montan wax and ceresin wax, petroleum waxes such as paraffin wax and microcrystalline wax, and synthetic waxes such as oxidized waxes, synthetic ester waxes, low molecular polyethylene, α-olefin-maleic anhydride copolymer wax, urethane-based waxes, Fischer-Tropsch wax and synthetic oil waxes. These waxes may be used alone, or two or more kinds of these may be used in combination.

Examples of the above-mentioned thermoplastic resins include ethylene copolymers such as ethylene-vinyl acetate copolymer, ethylene-vinyl butyrate copolymer, ethylene-(meth)acrylic acid copolymer, ethylene-(meth)acrylic acid alkyl ester copolymer, ethylene-acrylonitrile copolymer, ethylene-acrylamide copolymer and ethylene-N-methylolacrylamide copolymer and ethylene-styrene copolymer, (meth)acrylate resins, polyvinyl chloride, vinyl chloride copolymers such as vinyl chloride-vinyl alcohol copolymer, polyester resins, polyamide resins, epoxy resins, phenol resins, acetophenone-formaldehyde resin, cellulose resins, natural rubber, styrene-butadiene copolymer, isoprene polymer, chloroprene polymer, petroleum resins, styrene resins, rosin resins, terpene resins, coumarone-indene resin, and the like. These resins may be used alone, or two or more of these may be used in combination.

In the present invention, the mat layer, which is used if necessary, is mainly composed of a binder and a mat agent. As the mat agent, various particles may be used without any particular limitation. Examples thereof include inorganic particles such as silica, talc, titanium oxide, calcium carbonate and carbon black, and organic particles such as colored organic pigments. These particles may be used alone, or two kinds or more of these may be used in combination.

The proportion of the mat agent used is preferably in the range of 10 to 50 parts by weight, more preferably 20 to 40 parts by weight, with respect to 100 parts by weight of the mat layer. A proportion of the mat agent less than the above-mentioned range causes insufficient irregularities on the surface of the mat layer, resulting in insufficient effect of reducing the gloss of the printed image. On the other hand, a proportion of the mat agent exceeding the above-mentioned range causes insufficient strength of the mat layer, resulting in separation of the mat layer depending on printing conditions, and failing to exert the effect of reducing the gloss of the printed image.

As the binder of the mat layer, thermoplastic resins can be used without any particular limitation. With respect to the thermoplastic resins, any one or more may be selected from the same thermoplastic resins as those used in the hot-melt ink, and used.

As the substrate used for the heat-sensitive transfer recording medium of the present invention, various plastic films, such as those generally used as substrate films for heat-sensitive transfer recording media, can be used. Examples thereof include polyester films such as polyethylene terephthalate film, polyethylene naphthalate film and polyarylate film, polycarbonate film, polyamide film, aramide film, and the like. Moreover, thin paper sheets with high density such as condenser paper may be used. The thickness of the substrate is preferably in the range of 1 to 10 μm, more preferably, 2 to 7 μm, from the viewpoint of thermal conduction and strength.

On the surface opposite to the side of the substrate on which the hot-melt ink layer is provided, an anti-sticking layer composed of, for example, a material such as silicone resin, fluorine resin, nitrocellulose and acrylic resin, or various lubricating heat-resistant resins modified with these, for example, silicone-urethane resin and silicone-acrylic resin, may be provided.

In the heat-sensitive transfer recording medium of the present invention, an overcoat layer having heat-sensitive adhesive property may be provided on the hot-melt ink layer in order to improve the transferability of the hot-melt ink layer on a receptor.

The present invention will be more fully described by way of Examples. It is to be understood that the present invention is not limited to the Examples, and various change and modifications may be made in the present invention without departing from the spirit ans scope thereof.

EXAMPLES 1 TO 6 AND COMPARATIVE EXAMPLES 1 AND 2

The components as shown in Table 1 were uniformly melt-kneaded through a three-roll mill to prepare a hot-melt ink. Here, the values of the DBP oil absorption and specific surface area of the carbon black used in the hot-melt ink are shown in Table 2.

Each hot-melt ink containing no solvent obtained as described above was applied onto a polyethylene terephthalate film with a thickness of 6 $\mu$m having an anti-sticking layer made of silicone resin formed on one surface thereof, on the surface opposite to the anti-sticking layer, by using a hot-melt coater in a coating amount of 4.0 g/m$^2$ to produce a heat-sensitive transfer recording medium.

TABLE 1

| Formulation (parts by weight) | Ex. 1 | Ex. 2 | Ex. 3 | Ex. 4 | Ex. 5 | Ex. 6 | Com. Ex. 1 | Com. Ex. 2 |
|---|---|---|---|---|---|---|---|---|
| Paraffin wax | 50 | 48 | 46 | 52 | 57 | 54.5 | 50 | 48 |
| Carnauba wax | 20 | 20 | 20 | 20 | 20 | 20 | 20 | 20 |
| Ethylene-vinyl acetate copolymer | 10 | 10 | 10 | 10 | 10 | 10 | 10 | 10 |
| Carbon black A | 20 | 20 | 20 | 15 | — | — | — | — |
| Carbon black B | — | — | — | — | 13 | 13 | — | — |
| Carbon black C | — | — | — | — | — | — | 20 | — |
| Carbon black D | — | — | — | — | — | — | — | 20 |
| Oil-soluble dye | — | 2 | 4 | 3 | — | 2.5 | — | 2 |
| Total | 100 | 100 | 100 | 100 | 100 | 100 | 100 | 100 |

TABLE 2

| | DBP oil absorption | Specific surface area (BET method) |
|---|---|---|
| Carbon black A | 150 ml/100 g | 45 m$^2$/g |
| Carbon black B | 123 ml/100 g | 96 m$^2$/g |
| Carbon black C | 50 ml/100 g | 65 m$^2$/g |
| Carbon black D | 250 ml/100 g | 375 m$^2$/g |

EXAMPLE 7

The components shown in Table 3 were dispersed by means of an Attritor to prepare a coating liquid for mat-layer, and the coating liquid was applied onto the surface opposite to the anti-sticking layer of the same substrate as that used in Examples 1 to 6 by a gravure coating method in a coating amount of 0.5 g/m$^2$ to form a mat layer.

TABLE 3

| Component | Parts by weight |
|---|---|
| Polyester resin (Tg: 60° C., Molecular weight: 20,000) | 7 |
| Talc | 3 |
| Methyl ethyl ketone | 45 |
| Toluene | 45 |
| Total | 100 |

The hot-melt ink of Example 2 was applied onto the mat layer by means of a hot-melt coater in a coating amount of 4.0 g/m$^2$ to produce a heat-sensitive transfer recording medium.

Evaluation was made on each of the thus obtained hot-melt inks and each of the heat-sensitive transfer recording media with respect to the following points. The results of the evaluation are shown in Table 4.

A. Fluidity of Hot-Melt ink

With respect to each of the hot-melt inks, the yield value was measured at 90° C. by means of a parallel plate viscometer (made by Kabushiki Kaisha Yasuda Seiki Seisakusho) and the fluidity was evaluated on the basis of the yield values. The smaller the yield value, the better the fluidity.

◎:Yield value is less than 10.

○:Yield value is not less than 10 and less than 20.

X: Yield value is not less than 20.

B. Function of Preventing Troubles due to Static Electricity

The surface resistivity of the ink layer of each of the heat-sensitive transfer recording media and the quantity of charge thereof exerted when the surface of the ink layer was rubbed with a cotton cloth were measured and the function of preventing the static electricity was evaluated on the basis of these measurements.

The surface resistivity was measured by a measuring device Hiresta IP MCP-HT260 (made by Mitsubishi Chemical Corporation).

○: Surface resistivity is less than $1\times10^{13}$ Ω/□.

X: Surface resistivity is not less than $1\times10^{13}$ Ω/□.

The quantity of charge was determined by rubbing the surface of the ink layer with a cotton cloth reciprocally ten times, and measuring the quantity of charge immediately thereafter by means of a measuring device Statiron DZ 3 (made by Shishido Seidenki Kabushiki Kaisha).

○: Quantity of charge was within ±2.0 KV.

X: Quantity of charge was out of ±2.0 KV.

C. Gloss of Printed Image

Using each of the heat-sensitive transfer recording media, a printed image was formed on a receptor paper sheet (TTR-PW made by Mitsubishi Paper Mills Ltd.) by means of a thermal transfer printer, and the gloss of the resulting printed image was measured by means of a gloss meter (GM-26D made by Kabushiki Kaisha Murakami Shikisai Gijutsu Kenkyusho).

○: Gloss is less than 30.

X: Gloss is not less than 30.

TABLE 4

| | Ex. 1 | Ex. 2 | Ex. 3 | Ex. 4 | Ex. 5 | Ex. 6 | Ex. 7 | Com. Ex. 1 | Com. Ex. 2 |
|---|---|---|---|---|---|---|---|---|---|
| Ink fluidity | ○ | ◎ | ◎ | ◎ | ○ | ◎ | ◎ | ○ | X |
| Surface resistivity | ○ | ○ | ○ | ○ | ○ | ○ | ○ | X | ○ |
| Charge quantity | ○ | ○ | ○ | ○ | ○ | ○ | ○ | X | ○ |
| Gloss of image | X | X | X | X | X | X | ○ | X | X |

In addition to the materials and ingredients used in the Examples, other materials and ingredients can be used in Examples as set forth in the specification to obtain substantially the same results.

In the present invention, by using a specific carbon black as a colorant for a hot-melt ink containing no solvent, it is possible to impart a sufficient conductivity to an ink layer formed from the hot-melt ink without impairing the coating property of the hot-melt ink, and consequently to provide a heat-sensitive transfer recording medium that is free from troubles due to electrostatic charge.

What is claimed is:

1. A heat-sensitive transfer recording medium comprising a substrate and a heat-sensitive transfer ink layer provided on the substrate, the heat-sensitive transfer ink layer being a coating of a hot-melt ink containing no solvent therein, the heat-sensitive transfer ink layer containing carbon black having a DBP oil absorption of 100 to 200 ml/100 g and a BET specific surface area of 100 $m^2/g$ or less, and the heat-sensitive transfer ink layer having a surface resistivity of not more than $10^{13}$ Ω/□, wherein a mat layer is provided between the substrate and the heat-sensitive transfer ink layer.

2. The heat-sensitive transfer recording medium of claim 1, wherein the hot-melt ink contains an oil-soluble dye.

3. The heat-sensitive transfer recording medium of claim 2, wherein the carbon black is contained in the hot-melt ink in a range of 5 to 50 parts by weight with respect to 100 parts by weight of the hot-melt ink, and the oil-soluble dye is contained in a range of 1 to 30 parts by weight with respect to 100 parts by weight of the carbon black.

* * * * *